US007166559B2

(12) United States Patent
Odamura et al.

(10) Patent No.: US 7,166,559 B2
(45) Date of Patent: Jan. 23, 2007

(54) IMAGE FORMING METHOD, THERMAL TRANSFER SHEET AND INTERMEDIATE TRANSFER RECORDING MEDIUM

(75) Inventors: Kozo Odamura, Tokyo-To (JP); Satoshi Narita, Tokyo-To (JP)

(73) Assignee: Dai Nippon Printing Co., Ltd, Tokyo-To (JP)

( * ) Notice: Subject to any disclaimer, the term of this patent is extended or adjusted under 35 U.S.C. 154(b) by 160 days.

(21) Appl. No.: 10/742,632

(22) Filed: Dec. 19, 2003

(65) Prior Publication Data

US 2004/0241353 A1 Dec. 2, 2004

(30) Foreign Application Priority Data

Dec. 20, 2002 (JP) ..... 2002-370797

(51) Int. Cl.
*B41M 5/035* (2006.01)
*B41M 5/38* (2006.01)

(52) U.S. Cl. ..... 503/227; 156/235; 428/32.51

(58) Field of Classification Search ..... 503/227; 428/32.51, 32.76; 156/235
See application file for complete search history.

(56) References Cited

U.S. PATENT DOCUMENTS 5,506,189 A * 4/1996 Chou et al. ..... 503/227
6,407,037 B1 * 6/2002 Prugh et al. ..... 503/227
6,410,200 B1 * 6/2002 Williams et al. ..... 430/126
6,815,397 B2 * 11/2004 Ishida et al. ..... 503/227

FOREIGN PATENT DOCUMENTS

JP 62-238791 10/1987
JP 07-052522 2/1995

* cited by examiner

*Primary Examiner*—Bruce H. Hess
(74) *Attorney, Agent, or Firm*—Harness, Dickey & Pierce, P.L.C.

(57) ABSTRACT

Disclosed is a method for image formation which can improve adhesion, transferability, and print quality. The method for image formation comprises the steps of: providing an intermediate transfer recording medium comprising a separable receptive layer provided on at least one side of a substrate sheet; forming a first image on the receptive layer by using a thermal transfer sheet comprising a dye layer; forming a transparent adhesive layer on the receptive layer with the first image provided thereon by using a thermal transfer sheet comprising a transparent adhesive layer; forming a second image on the transparent adhesive layer by using a thermal transfer sheet comprising a heat-fusion ink layer; and transferring the processed receptive layer from the intermediate transfer recording medium to an object to form an image on the object.

5 Claims, 3 Drawing Sheets

IMAGE FORMING METHOD, THERMAL TRANSFER SHEET AND INTERMEDIATE TRANSFER RECORDING MEDIUM

BACKGROUND OF THE INVENTION

1. Field of the Invention

The present invention relates to a method for image formation on an object, a thermal transfer sheet for use in this method, and an intermediate transfer recording medium comprising a receptive layer provided separably on at least one side of a substrate sheet.

2. Background Art

Thermal transfer has hitherto been extensively used as a simple printing method. The thermal transfer is a method which comprises the steps of: putting a thermal transfer sheet, comprising a colorant layer provided on one side of a substrate sheet, on top of a thermal transfer image-receiving sheet optionally provided with an image-receptive layer; and image-wise heating the backside of the thermal transfer sheet by heating means such as a thermal head to selectively transfer the colorant contained in the colorant layer to form an image on the thermal transfer image-receiving sheet.

Thermal transfer methods are classified into thermal ink transfer (hot melt-type thermal transfer) and thermal dye sublimation transfer (sublimation-type thermal transfer). The thermal ink transfer is a method for image formation wherein a thermal transfer sheet comprising a substrate sheet, such as a PET film, bearing thereon a heat-fusion ink layer, formed of a dispersion of a colorant, such as a pigment, in a binder, such as a hot-melt wax or resin, is provided and energy according to image information is applied to heating means such as a thermal head to transfer the colorant together with the binder onto a thermal transfer image-receiving sheet such as paper or plastic sheets. Images produced by the thermal ink transfer have high density and possess high sharpness and are suitable for recording binary images of characters or the like.

On the other hand, the thermal dye sublimation transfer is a method for image formation which comprises the steps of: providing a thermal transfer sheet comprising a substrate sheet, such as a PET film, bearing thereon a dye layer formed of a dye, which is mainly thermally transferred by sublimation, dissolved or dispersed in a resin binder; and applying energy according to image information to heating means such as a thermal head to transfer only the dye onto a thermal transfer image-receiving sheet comprising a substrate sheet, such as paper or a plastic, optionally provided with a dye-receptive layer. The thermal dye sublimation transfer can regulate the amount of the dye transferred according to the quantity of energy applied and thus can form gradation images of which the image density has been regulated dot by dot of the thermal head. Further, since the colorant used is a dye, the formed image is transparent, and the reproduction of intermediate colors produced by superimposing different color dyes on top of each other or one another is excellent. Accordingly, high-quality photograph-like full color images can also be formed with excellent reproduction of intermediate colors by transferring different color dyes, such as yellow, magenta, cyan, and black, onto a thermal transfer image-receiving sheet, so as to superimpose the color dyes on top of each other or one another, from a thermal transfer sheet of the different colors.

Specific applications of the thermal transfer image-receiving sheet used in the thermal transfer method are various, and representative examples thereof include proofs of printing, output of images, output of plans and designs, for example, in CAD/CAM, output of various medical analytical instruments and measuring instruments, such as CT scans and endoscope cameras, alternative to instant photographs, output and printing of photograph-like images of a face or the like onto identification cards or ID cards, credit cards, and other cards, and composite photographs and commemorative photographs, for example, in amusement facilities, such as amusement parks, game centers (amusement arcades), museums, and aquaria.

The diversification of the applications has led to an increasing demand for the formation of a thermally transferred image on a desired object. One method proposed for meeting this demand comprises the steps of: providing an intermediate transfer recording medium comprising a substrate and a receptive layer separably provided on the substrate; providing a thermal transfer sheet comprising a dye layer and a heat-fusion ink layer; transferring the colorants such as dyes or pigments from the thermal transfer sheet onto the receptive layer in the intermediate transfer recording medium to form an image on the receptive layer; and then heating the intermediate transfer recording medium to transfer the receptive layer with the image formed thereon onto an object (Japanese Patent Laid-Open No. 238791/1987).

In the transfer of an image-receptive layer onto an object, in order to surely transfer an image-receptive layer, formed by thermally transferring a colorant such as a sublimation dye or a heat-fusion ink in its part to be transferred, on an object, a method for image formation has been proposed in which a colorant is transferred from a thermal transfer sheet by a thermal transfer recording method onto the image receptive layer face of an intermediate transfer recording medium comprising an image-receptive layer provided separably on one side of a substrate sheet to form an image on the image-receptive layer and the image-receptive layer with the image formed thereon is then transferred onto an object through an adhesive layer (Japanese Patent Laid-Open No. 52522/1995).

In the method for image formation in which the above intermediate transfer recording medium in its receptive layer with an image formed thereon by thermally transferring a sublimation dye or a heat-fusion ink is transferred onto an object, however, the image on the receptive layer is formed by directly transfer of a sublimation dye or a heat-fusion ink. In this case, a release agent is added to the receptive layer from the viewpoint of forming an image without fusion between the receptive layer and the dye layer. When a heat-fusion ink is transferred onto the receptive layer, however, it has been often pointed out that the adhesion and transferability of the heat-fusion ink to the receptive layer are so low that print quality is not good.

SUMMARY OF THE INVENTION

The present inventor has now found a method for image formation, in which when an intermediate transfer recording medium comprising a receptive layer provided separably on one side of a substrate sheet is provided, a sublimation dye and a heat-fusion ink are thermally transferred onto the receptive layer to form an image on the receptive layer, and the image formed receptive layer is then transferred from the intermediate transfer recording medium to form an image onto an object, advantages can be provided including that the separability of the receptive layer from the dye layer can be ensured, the adhesion and transferability of the heat-fusion ink layer onto the receptive layer are good, and a high-quality thermally transferred image can be provided.

The present invention has been made based on such finding. Accordingly, an object of the present invention is to provide a method for image formation which can improve adhesion, transferability and print quality.

According to one aspect of the present invention, there is provided a method for image formation, comprising the steps of:

providing an intermediate transfer recording medium comprising a receptive layer provided separably on at least one side of a substrate sheet;

forming a first image on the receptive layer by using a thermal transfer sheet comprising a dye layer;

forming a transparent adhesive layer on the receptive layer with the first image formed thereon by using a thermal transfer sheet comprising a transparent adhesive layer;

forming a second image on the transparent adhesive layer by using a thermal transfer sheet comprising a heat-fusion ink layer; and transferring the processed receptive layer from the intermediate transfer recording medium to an object to form an image on the object.

According to another aspect of the present invention, there is provided a thermal transfer sheet for use in the above method for image formation. The thermal transfer sheet comprises a dye layer, a transparent adhesive layer, or a heat-fusion ink layer. According to still another aspect of the present invention, there is provided an another embodiment of a thermal transfer sheet. The thermal transfer sheet comprises a dye layer, a transparent adhesive layer, and a heat-fusion ink layer.

According to a further aspect of the present invention, there is provided an intermediate transfer recording medium for use in the above method for image formation. The intermediate transfer recording medium satisfies a requirement represented by equation (I)

$$T1>T2 \quad (I)$$

wherein

T1 represents the transferability of the surface of the heat-fusion ink layer onto the surface of the receptive layer and is defined as a gradation value as measured by a method in which the intermediate transfer medium comprising the receptive layer is put on top of the thermal transfer sheet comprising the heat-fusion ink layer so as for the surface of the receptive layer to face the surface of the heat-fusion ink layer and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the receptive layer; and T2 represents the transferability of the surface of the heat-fusion ink layer onto the surface of the transparent adhesive layer and is defined as a gradation value as measured by a method in which the intermediate transfer medium comprising the receptive layer is put on top of the thermal transfer sheet comprising the transparent adhesive layer so as for the surface of the receptive layer to face the surface of the transparent adhesive layer, the assembly is heated with a heating device to form a transparent adhesive layer onto the surface of the receptive layer, the thermal transfer sheet comprising the heat-fusion ink layer is then put on top of the transparent adhesive layer so as for the surface of the transparent adhesive layer to face the surface of the heat-fusion ink layer, and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the transparent adhesive layer.

DESCRIPTION OF REFERENCE CHARACTERS IN THE DRAWINGS

Figure 1:
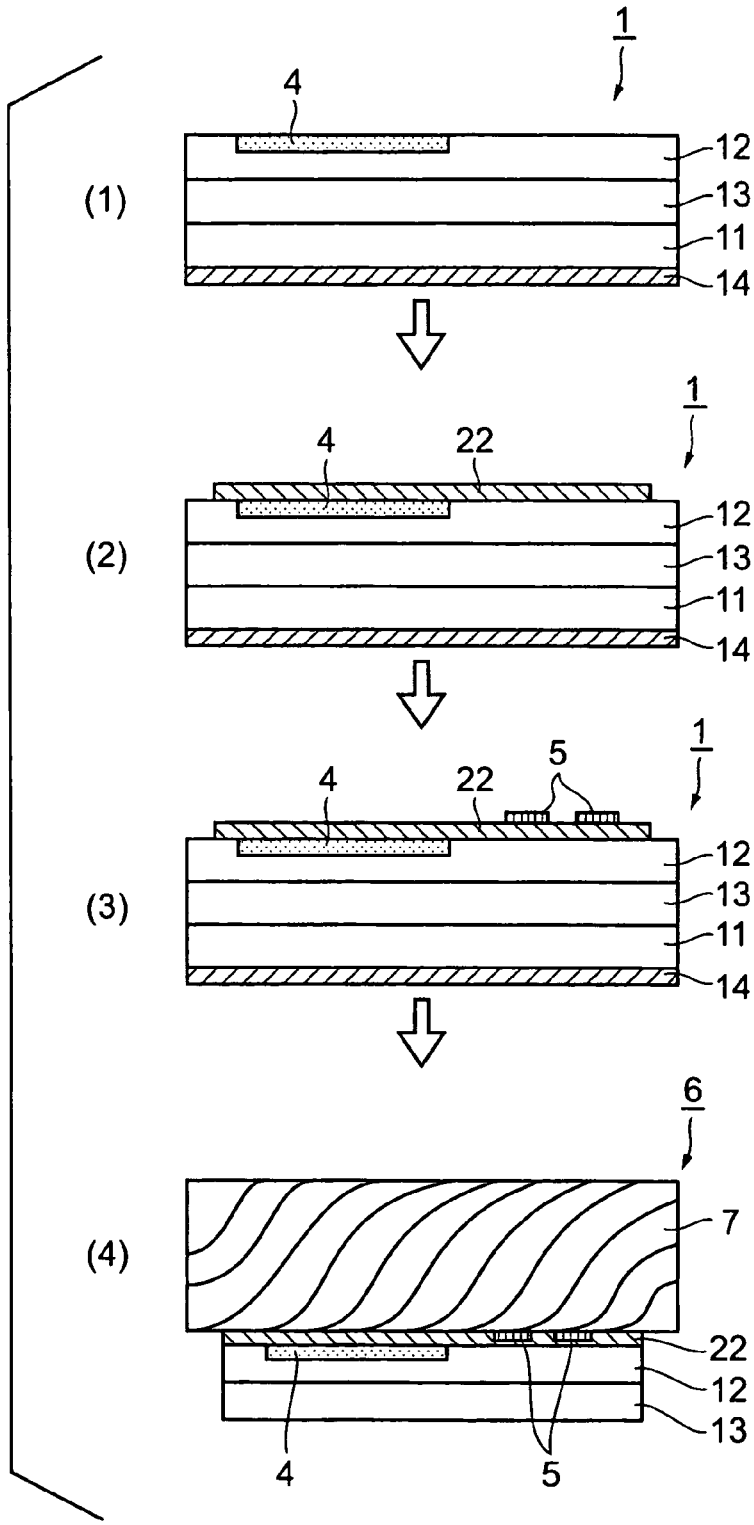
FIG. 1 is a schematic diagram illustrating the method for image formation according to the present invention.

1: Intermediate transfer recording medium, 2: adhesive layer transfer sheet, 3: thermal transfer sheet, 4: first image, 5: second image, 6: image formed object, 7: object, 8: magnetic stripe (information recording part), 11: substrate sheet, 12: receptive layer, 13: peel layer, 14: backside layer, 21: substrate sheet, 22: transparent adhesive layer, 23: release layer, 24: backside layer, 31: substrate sheet, 32: release layer, 33: transparent adhesive layer, 34: backside layer, 35: yellow dye layer, 36: magenta dye layer, and 37: cyan dye layer.

DETAILED DESCRIPTION OF THE INVENTION

Embodiments of the Invention

In a first embodiment of the present invention, there is provided a method for image formation, comprising the steps of: providing an intermediate transfer recording medium comprising a receptive layer provided separably on at least one side of a substrate sheet; forming a first image on the receptive layer by using a dye layer in a thermal transfer sheet; then thermally transferring a transparent adhesive layer onto the receptive layer; transferring a heat-fusion ink layer onto a transparent adhesive layer transfer part provided on the receptive layer to form a second image; and then transferring the image formed receptive layer from the intermediate transfer recording medium to an object to form an image on the object.

In a second embodiment of the present invention, there is provided a method for image formation in which, in the first embodiment, the transparent adhesive layer is transferred onto only a desired region of the receptive layer in the intermediate transfer recording medium.

In a third embodiment of the present invention, there is provided a method for image formation in which, in the first embodiment, the receptive layer is not adhered onto the object and the receptive layer only in its adhesive layer formed part is adhered onto the object.

In a fourth embodiment of the present invention, there is provided a thermal transfer sheet. The thermal transfer sheet is adapted for use in a method which comprises the steps of: providing an intermediate transfer recording medium comprising a separable receptive layer provided on at least one side of a substrate sheet; forming a first image on the receptive layer by using a dye layer in a thermal transfer sheet; then thermally transferring a transparent adhesive layer onto the receptive layer; transferring a heat-fusion ink layer onto a transparent adhesive layer transfer part provided on the receptive layer to form a second image; and then transferring the image formed receptive layer from the intermediate transfer recording medium to an object to form an image on the object. This thermal transfer sheet comprises a substrate sheet and, provided on the substrate sheet, a dye layer(s) of at least one color, a transparent adhesive layer of at least one panel, and a heat-fusion ink layer(s) of at least one color provided in that order in a face serial manner.

In a fifth embodiment of the present invention, there is provided an image formed object prepared by the above method for image formation.

In a sixth embodiment of the present invention, there is provided an intermediate transfer recording medium. The intermediate transfer recording medium comprises a receptive layer provided separably on at least one side of a substrate sheet and is adapted for use in a method for image formation which comprises the steps of: forming a first image on the receptive layer by using a dye layer in a thermal transfer sheet; then thermally transferring a transparent adhesive layer onto the receptive layer; transferring a heat-fusion ink layer onto a transparent adhesive layer transfer part provided on the receptive layer to form a second image; and then transferring the image formed receptive layer from the intermediate transfer recording medium to an object to form an image on the object. The intermediate transfer recording medium satisfies a requirement represented by formula T1>T2 wherein T1 represents the transferability of the surface of the heat-fusion ink layer onto the surface of the receptive layer, and T2 represents the transferability of the surface of the heat-fusion ink layer onto the surface of the transparent adhesive layer formed by transfer onto the surface of the receptive layer.

Transferability T1 is defined as a gradation value (gradation X/255) as measured by a method in which the intermediate transfer medium comprising the receptive layer is put on top of the thermal transfer sheet comprising the heat-fusion ink layer so as for the surface of the receptive layer to face the surface of the heat-fusion ink layer and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the receptive layer.

Transferability T2 is defined as a gradation value (gradation Y/255) as measured by a method in which the intermediate transfer medium comprising the receptive layer is put on top of the thermal transfer sheet comprising the transparent adhesive layer so as for the surface of the receptive layer to face the surface of the transparent adhesive layer, the assembly is heated with a heating device, such as a thermal head or a heat roll, to form a transparent adhesive layer onto the surface of the receptive layer, the thermal transfer sheet comprising the heat-fusion ink layer is then put on top of the transparent adhesive layer so as for the surface of the transparent adhesive layer to face the surface of the heat-fusion ink layer, and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the transparent adhesive layer.

In the method for image formation according to the present invention, a first thermally transferred dye image is formed on a receptive layer in an intermediate transfer recording medium, and a transparent adhesive layer is then transferred onto the receptive layer. A heat-fusion ink layer is transferred on the transparent adhesive layer transfer part to form a second thermally transferred image. In this case, even when the receptive layer contains a release agent from the viewpoint of preventing heat fusing between the receptive layer and the dye layer, the adhesion and transferability of the heat-fusion ink layer to the receptive layer are good and high-quality thermally transferred images of both thermally dye transferred and thermally ink transferred can be simultaneously realized.

1. Method for Image Formation

An embodiment of the method for image formation according to the present invention will be described with reference to FIG. 1. FIG. 1 is a schematic diagram illustrating the method for image formation according to the present invention.

(1) An intermediate transfer recording medium 1 comprising a substrate sheet 11 and a receptive layer 12 provided on one side of the substrate sheet 11 through a peel layer 13 is provided. In the intermediate transfer recording medium 1, a backside layer 14 is provided on the substrate sheet 11 on the other side of the substrate sheet 11. A first image 4 is formed on the receptive layer 12 by transfer of a dye layer from a separately provided thermal transfer sheet (not shown). Since the peel layer 13 is provided, the receptive layer 12 is easily separated from the substrate sheet 11 upon thermal transfer onto an object. Further, since the backside layer 14 is provided on the other side of the substrate sheet 11, adverse effects such as sticking and cockling due to heat of a thermal head, a heat roll or the like can be prevented.

(2) Next, a transparent adhesive layer 22 is thermally transferred from a separately provided thermal transfer sheet (not shown) on the receptive layer 12.

(3) A second image 5 is then formed on the transfer part of the transparent adhesive layer 22 provided on the receptive layer 12 by transferring a heat-fusion ink layer in a separately provided thermal transfer sheet.

(4) Thereafter, the receptive layer 12, with the first image 4 and the second image 5 formed thereon, and the peel layer 13 are transferred from the intermediate transfer recording medium 1 onto an object 7 to prepare the object 7 with an image formed thereon, that is, an image formed object 6.

Specific Embodiments of Method for Image Formation

The method for image formation according to the present invention, in which two thermally transferred images of a sublimation dye transferred image and a thermal ink transferred image are formed on any object using an intermediate transfer recording medium and thermal transfer sheets, will be described in more detail.

The intermediate transfer recording medium 1 and a thermal transfer sheet comprising a dye layer on a substrate sheet are provided. The intermediate transfer recording medium and the thermal transfer sheet are put on top of each other so that the receptive layer 12 in the intermediate transfer recording medium is brought into pressure contact with the dye layer in the thermal transfer sheet between a heating device, such as a thermal head, and a platen roll. The heating device in its heat generating part selectively undergoes heat generation according to image information to transfer a sublimation dye as a colorant of the dye layer on the thermal transfer sheet onto the receptive layer 12 in the intermediate transfer recording medium, whereby a first image 4 is recorded (FIG. 1 (1)).

Next, a thermal transfer sheet comprising a transparent adhesive layer provided on a substrate sheet is provided. The intermediate transfer recording medium and the thermal transfer sheet are put on top of each other so that the receptive layer 12 in the intermediate transfer recording medium is brought into pressure contact with the transparent adhesive layer 22 between a heating device, such as a thermal head, and a platen roll. The heating device in its heat generating part selectively undergoes heat generation to transfer the transparent adhesive layer 22 on the substrate sheet in the thermal transfer sheet onto a desired region of the receptive layer 12 in the intermediate transfer recording medium (FIG. 1 (2)).

The transparent adhesive layer is transferred onto the whole receptive layer or also onto the first image 4 as shown in FIG. 1 (2). However, it should be noted that the area of the receptive layer on which the transparent adhesive layer is to be transferred is not limited to this only. For example, the transparent adhesive layer may be transferred onto the receptive layer 12 only in its part not including the first image and preferably only onto a desired region.

Next, a thermal transfer sheet comprising a heat-fusion ink layer provided on a substrate sheet is provided. The intermediate transfer recording medium and the thermal transfer sheet are put on top of each other so that the receptive layer 12 in the intermediate transfer recording medium is brought into pressure contact with the heat-fusion ink layer between a heating device, such as a thermal head, and a platen roll. The heating device in its heat generating part selectively undergoes heat generation according to image information to transfer the heat-fusion ink layer on the substrate sheet in the thermal transfer sheet onto the transferred adhesive layer 22 in the intermediate transfer recording medium, whereby a second image 5 is recorded (FIG. 1 (3)).

Next, the intermediate transfer recording medium is put on top of an object 7 so that an image face of the receptive layer 12, onto which the first image 4 and the transparent adhesive layer 22 are transferred and the second image 5 is then formed, is brought into pressure contact with the object 7. In this state, heat is applied to the assembly by means of heating means such as a thermal head, a hot stamp, or a heat roll to cause transfer from the intermediate transfer recording medium onto the object 7, whereby an image formed object 6 is prepared (FIG. 1 (4)).

Regarding the heating means used for the transfer of the receptive layer onto the object, a thermal head or a hot stamp is preferably used for partial transfer of the receptive layer, while the use of a hot roll system is preferred for transfer of the receptive layer on the whole area of the object.

FIG. 1 (4) shows an image formed object 6 in which the image formed receptive layer 12, together with the peel layer 13, has been transferred from the substrate sheet in the intermediate transfer recording medium onto the object 7. Further, as shown in FIG. 1 (4), the receptive layer 12 only in its part corresponding to the adhesive layer 22-interposed layers is transferred and adhered onto the object 7 through the adhesive layer 22 without direct contact of the receptive layer 12 with the object 7.

A series of processing procedures as described above can realize the formation of a desired image on an object.

2. Thermal Transfer Sheet

Figure 2:
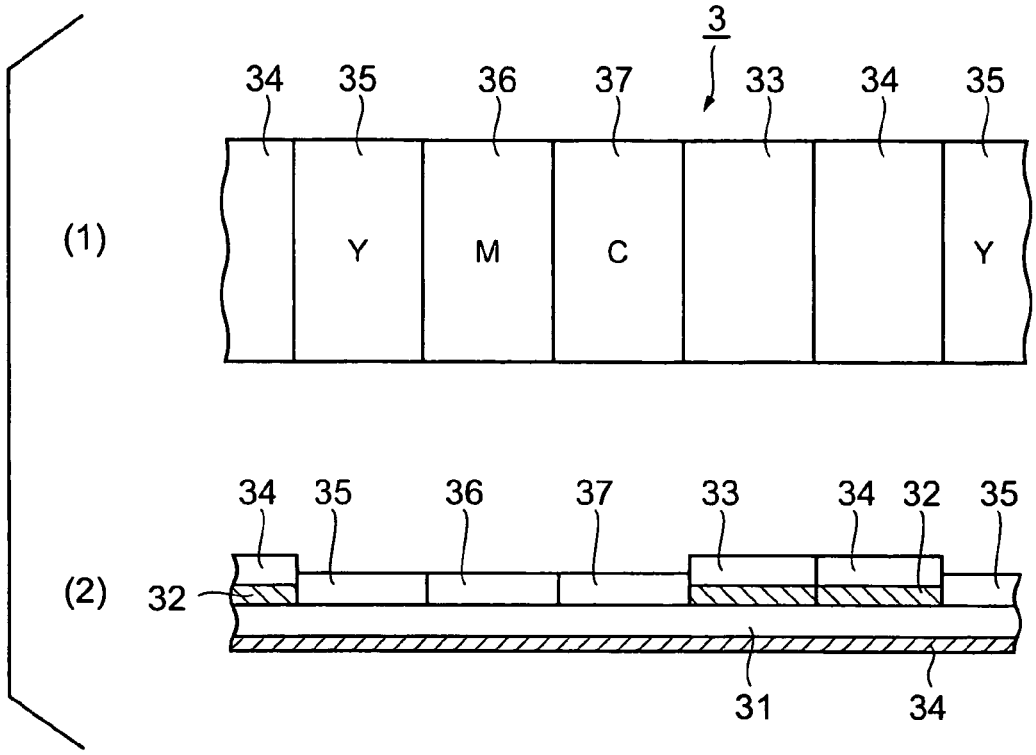
FIG. 2 is a schematic diagram showing one embodiment of the thermal transfer sheet according to the present invention.

One embodiment of the method for image formation according to the present invention will be described with reference to FIG. 2. FIG. 2 is a schematic diagram showing one embodiment of the thermal transfer sheet according to the present invention, wherein FIG. 2 (1) is a plan view and FIG. 2 (2) a cross-sectional view of the thermal transfer sheet shown in FIG. 2 (1). A thermal transfer sheet 3 includes a substrate sheet 31. A yellow dye layer 35, a magenta dye layer 36, a cyan dye layer 37, a transparent adhesive layer 33, and a heat fusion-ink layer 34 are provided in that order in a face serial manner on the substrate sheet 31. A release layer 32 is provided between the transparent adhesive layer 33 and the substrate sheet and between the heat-fusion ink layer and the substrate sheet to improve the transferability of the transparent adhesive layer 33 and the heat-fusion ink layer 34. A backside layer 34 is provided on the opposite side of the substrate sheet 31 to prevent adverse effects such as sticking or cockling caused by heat of a thermal head, a heat roll or the like.

In FIG. 2, all of dye layers, a transparent adhesive layer, and a heat-fusion ink layer are provided on an identical substrate sheet. The form of the provisions of these layers is not limited to this embodiment only, and preferred embodiments of the provision of these layers include one in which individual layers are provided on respective separate substrate sheets and one in which two types of layers of the dye layers and the transparent adhesive layer or two types of layers of the transparent adhesive layer and the heat-fusion ink layer are provided on an identical substrate sheet.

The use of the thermal transfer sheet as shown in FIG. 2, in which all of dye layers, a transparent adhesive layer, and a heat-fusion ink layer are provided in that order in a face serial manner on a substrate sheet, is preferred for the following reason. When this thermal transfer sheet is used, in the method for image formation according to the present invention, the thermal transfer of the dye layer, the transparent adhesive layer, and the heat-fusion ink layer can be carried out using a thermal transfer recording apparatus provided with one heating means such as a thermal head (a thermal transfer printer) in an in-line manner. Specifically, a first image is formed by transfer from the dye layer onto the receptive layer in the intermediate transfer recording medium. Thereafter, the transparent adhesive layer is thermally transferred onto the receptive layer, and the heat-fusion ink layer is then transferred onto the transparent adhesive layer transfer part provided on the receptive layer to form a second image. The transfer in an in-line manner is preferred because of high efficiency.

A method may also be adopted wherein at least one of the dye layers, the transparent adhesive layer, and the heat-fusion ink layer is transferred in an off-line manner by means of a thermal transfer printer separately from the other layers. In this case, at least two thermal transfer sheets are used. Examples of the combination of the at least two thermal transfer sheets include one wherein a thermal transfer sheet comprising only a dye layer provided on a substrate sheet is used in combination with a thermal transfer sheet comprising a transparent adhesive layer and a heat-fusion ink layer provided on another substrate sheet, one wherein a thermal transfer sheet comprising a dye layer and a transparent adhesive layer provided on a substrate sheet is used in combination with a thermal transfer sheet comprising a heat-fusion ink layer provided on another substrate sheet, and one wherein thermal transfer sheets comprising a dye layer, a transparent adhesive layer, and a heat-fusion ink layer provided on respective separate substrate sheets are used in combination.

Figure 3:
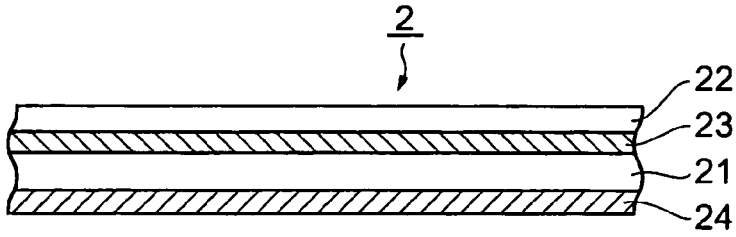
FIG. 3 is a schematic cross-sectional view showing an embodiment of an adhesive layer transfer sheet usable in the present invention.

FIG. 3 is a schematic cross-sectional view showing an embodiment of an adhesive layer thermal transfer sheet 2 usable in the present invention. This adhesive layer thermal transfer sheet 2 comprises a transparent adhesive layer 22 on one side of a substrate sheet 21 through a release layer 23. In this case, among a dye layer, a transparent adhesive layer, and a heat-fusion ink layer, only the transparent adhesive layer 22 is provided on the substrate sheet 21. A backside layer 24 is provided on the other side of the substrate sheet 21.

The construction of the thermal transfer sheet will be described.

(Substrate Sheet)

The substrate sheet 21, 31, on which a dye layer, a transparent adhesive layer, and a heat-fusion ink layer are formed and supported, may be the same as that used in an intermediate transfer recording medium which will be described below.

(Backside Layer)

The backside layer 24, 34 may be provided on the other side of the substrate sheet to prevent adverse effects such as sticking or cockling caused by heat of a thermal head or the like.

The backside layer may be the same as that in the intermediate transfer recording medium which will be described later.

(Dye Layer)

The dye layer containing a sublimable dye may be formed from a coating liquid comprising a sublimable dye having a desired hue such as yellow, magenta, cyan, or black, a binder resin, and other optional ingredients. The sublimable dyes, binder resins and the like may be those known in the art and are not particularly limited. The dye layer may be formed by a conventional method, that is, by preparing a coating liquid for dye layer formation, coating the coating liquid onto a substrate sheet by gravure printing or the like and drying the coating. The thickness of the dye layer may be about 0.2 to 3 $g/m^2$ on a dry basis.

A conventional primer layer may be provided between the substrate sheet and the dye layer to improve the adhesion between the substrate sheet and the dye layer.

(Heat-Fusion Ink Layer)

The heat-fusion ink layer 34 comprises conventional colorant and binder. If necessary, various additives such as mineral oils, vegetable oils, higher fatty acids such as stearic acid, plasticizers, thermoplastic resins, and fillers may be added. Waxes usable as the binder include, for example, microcrystalline wax, carnauba wax, and paraffin wax. Additional waxes include various waxes, for example, Fischer-Tropsh wax, various low-molecular weight polyethylenes, Japan wax, beeswax, spermaceti, insect wax, wool wax, shellac wax, candelilla wax, petrolactam, polyester wax, partially modified wax, fatty esters, and fatty amides. Among them, waxes having a melting point of 50 to 85° C. are particularly preferred. When the melting point is below 50° C., a problem of storage stability occurs. On the other hand, when the melting point is above 85° C., sensitivity in printing is unsatisfactory.

Examples of resins usable as the binder include ethylene-vinyl acetate copolymer, ethylene-acrylic ester copolymer, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, fluororesin, polyvinylformal, polyvinyl butyral, acetylcellulose, nitrocellulose, polyvinyl acetate, polyisobutylene, ethylcellulose, and polyacetal. In particular, resins having a relatively low softening point, for example, a softening point of 50 to 80° C., which have hitherto been used as heat-sensitive adhesives, are preferred.

The colorant may be properly selected from conventional organic or inorganic pigments or dyes. For example, pigments or dyes having satisfactory color density and free from discoloration and fading upon exposure to light, heat or the like are preferred. Further, materials, which cause color development upon heating, and materials, which cause color development upon contact with a component coated onto the surface of the object, may also be used. Colors of colorants are not limited to cyan, magenta, yellow, and black, and colorants of other various colors may also be used.

The heat-fusion ink layer may be formed by mixing the above colorant component and binder component and optionally a solvent component such as water or an organic solvent to prepare a coating liquid for heat-fusion ink layer formation and coating the coating liquid by a conventional method such as hot melt coating, hot lacquer coating, gravure coating, gravure reverse coating, or roll coating. The formation of the heat-fusion ink layer using an aqueous or nonaqueous emulsion coating liquid may also be used. The thickness of the heat-fusion ink layer should be determined so as to provide a good balance between necessary print density and heat sensitivity and is preferably in the range of 0.1 to 30 $g/m^2$, more preferably about 1 to 20 $g/m^2$.

The heat-fusion ink layer may have a single-layer structure, or alternatively may have a multilayer structure. For example, when the heat-fusion ink layer is formed in a two-layer structure, in the layer which comes into contact with the adhesive layer upon transfer, the same thermoplastic resin as used in the adhesive layer is preferably used as a component having excellent adhesion to and high compatibility with the component of the adhesive layer. Further, in this case, in the other layer, which comes into contact with the object upon transfer, the use of a component having high adhesion to the surface of the object is preferred.

(Transparent Adhesive Layer)

Materials usable for the transparent adhesive layer 22, 33 include thermoplastic synthetic resins, naturally occurring resins, rubbers, and waxes, and examples thereof include: synthetic resins, for example, cellulose derivatives such as ethylcellulose and cellulose acetate propionate, styrene polymers such as polystyrene and poly-α-methylstyrene, acrylic resins such as polymethyl methacrylate, polyethyl methacrylate, and polyethyl acrylate, vinyl resins such as polyvinyl chloride, polyvinyl acetate, vinyl chloride-vinyl acetate copolymer, and polyvinyl butyral, polyester resins, polyamide resins, epoxy resins, polyurethane resins, ionomers, ethylene-acrylic acid copolymers, and ethylene-acrylic ester copolymers; and tackifiers, for example, naturally occurring resin and synthetic rubber derivatives, such as rosins, rosin-modified maleic acid resins, ester gums, polyisobutylene rubbers, butyl rubbers, styrene-butadiene rubbers, butadiene-acrylonitrile rubbers, polyamide resins, and polychlorinated olefins.

The transparent adhesive layer comprises a composition containing one or at least two of the above materials, and the use of a material, which develops an adhesive property upon heating, particularly a thermoplastic resin having a glass transition temperature (Tg) of 50 to 80° C., is preferred. The thickness of the transparent adhesive layer is determined by taking into consideration the adhesion to the receptive layer and the adhesion to the object and the operability. In general, however, the thickness of the transparent adhesive layer is preferably about 0.05 to 5.0 g/m$^2$ on a dry basis.

The adhesive layer may have a single-layer structure or a multilayer structure. For example, when the adhesive layer is formed in a two-layer structure, in the layer which comes into contact with the receptive layer upon transfer, the same thermoplastic resin as used in the receptive layer is preferably used as a component having excellent adhesion to and high compatibility with the component of the receptive layer. Further, in this case, in the other layer, which comes into contact with the object upon transfer, the use of a component having high adhesion to the surface of the object is preferred.

(Release Layer)

In the thermal transfer sheet used in the present invention, a release layer 32 may be provided between at least one of the transparent adhesive layer and the heat-fusion ink layer, and the substrate sheet to improve the transferability.

The release layer contains a binder resin and optionally a releasable material. Binder resins usable herein include thermoplastic resins, for example, acrylic resins, such as polymethyl methacrylate, polyethyl methacrylate, polybutyl acrylate, vinyl resins, such as polyvinyl acetate, vinyl chloride-vinyl acetate copolymer, polyvinyl alcohol, and polyvinylbutyral, and cellulose derivatives, such as ethylcellulose, nitrocellulose, and cellulose acetate, and thermosetting resins, for example, unsaturated polyester resins, polyester resins, polyurethane resins, and aminoalkyd resins. Releasable materials include waxes, silicone wax, silicone resins, melamine resins, fluororesins, fine powders of talc or silica, and lubricants such as surfactants or metal soaps. The release layer may be formed in the same manner as used in the formation of the receptive layer. The thickness of the release layer is preferably in the range of about 0.1 to 5 g/m$^2$ on a dry basis.

3. Intermediate Transfer Recording Medium

The intermediate transfer recording medium according to the present invention is used for the method for image formation according to the present invention. The intermediate transfer recording medium satisfies a requirement represented by equation (I)

$$T1>T2 \quad (I)$$

wherein

T1 represents the transferability of the surface of the heat-fusion ink layer onto the surface of the receptive layer and is defined as a gradation value as measured by a method in which the intermediate transfer medium comprising the receptive layer is put on top of the thermal transfer sheet comprising the heat-fusion ink layer so as for the surface of the receptive layer to face the surface of the heat-fusion ink layer and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the receptive layer; and T2 represents the transferability of the surface of the heat-fusion ink layer onto the surface of the transparent adhesive layer and is defined as a gradation value as measured by a method in which the intermediate transfer medium comprising the receptive layer is put on top of the thermal transfer sheet comprising the transparent adhesive layer so as for the surface of the receptive layer to face the surface of the transparent adhesive layer, the assembly is heated with a heating device to form a transparent adhesive layer onto the surface of the receptive layer, the thermal transfer sheet comprising the heat-fusion ink layer is then put on top of the transparent adhesive layer so as for the surface of the transparent adhesive layer to face the surface of the heat-fusion ink layer, and energy is applied to the assembly from the backside of the thermal transfer sheet by means of a thermal head with a resolution of 300 dpi and an average resistance value of 3100 Ω under conditions of speed 16 msec/line and pulse duty 65% to transfer the whole heat-fusion ink layer onto the surface of the transparent adhesive layer.

In the present invention, T1 and T2 represent the so-called "gradation values." Specifically, the gradation values of T1 and T2 are each 1 to 255 obtained by derivation from conditions defined in T1 and T2. Therefore, in the present invention, the gradation values of T1 and T2 are represented by T1: (X)/255 gradation and T2: (Y)/255 gradation.

The above transferabilities T1 and T2 represent the adhesion between the receptive layer or the transparent adhesive layer in the intermediate transfer recording medium and the heat-fusion ink layer in the thermal transfer sheet in the case where the heat-fusion ink layer has been brought into contact with and thermally transferred onto the receptive layer or the transparent adhesive layer. The smaller the transferability T value, that is, the smaller the gradation value, the lower the energy required for the transfer and the better the adhesion between the heat-fusion ink layer and the surface of the object. On the other hand, the larger the transferability T value, that is, the larger the gradation value, the higher the energy required for the transfer and the lower the adhesion between the heat-fusion ink layer and the surface of the object.

The construction of the intermediate transfer recording medium will be described.

(Substrate Sheet)

The substrate sheet 11 constituting the intermediate transfer recording medium 1 is not particularly limited, and the same substrate sheet as used in the conventional intermediate transfer recording medium as such may be used. Specific examples of preferred substrate sheet include: thin paper, such as glassine paper, capacitor paper, or paraffin-waxed paper; and stretched or unstretched films of plastics, for example, highly heat resistant polyesters, such as polyethylene terephthalate, polyethylene naphthalate, polybutylene terephthalate, polyphenylene sulfide, polyether ketone, or polyether sulfone, and other plastics, such as polypropylene, polycarbonate, cellulose acetate, polyethylene derivative, polyvinyl chloride, polyvinylidene chloride, polystyrene, polyamide, polyimide, polymethylpentene, or ionomer.

Composite films comprising a laminate of two or more materials selected from the above materials may also be used. The thickness of the substrate sheet may be properly selected according to the material so as to provide proper strength, heat resistance and other properties. In general, however, the thickness of the substrate sheet is preferably about 1 to 100 μm.

In the intermediate transfer recording medium according to the present invention, if necessary, a conventional backside layer may be provided on the backside of the substrate sheet, i.e., the surface of the substrate sheet remote from the receptive layer, from the viewpoint of preventing adverse effect such as heat-derived sticking, cockling or the like caused by a thermal head, a heat roll or the like as means for retransferring the image formed transfer part onto the object.

(Receptive Layer)

The receptive layer 12 is provided so as to locate on the surface of the intermediate transfer recording medium. An image is formed by thermal transfer on the receptive layer from a thermal transfer sheet having a dye layer. The intermediate transfer recording medium in its receptive layer with the image formed thereon is transferred onto an object, and, thus, a print is formed.

For this reason, a conventional resin material, which is receptive to a sublimable dye as a thermally transferable colorant may be used as the material for the receptive layer. Examples of materials usable herein include: polyolefin resins such as polypropylene; halogenated resins such as polyvinyl chloride or polyvinylidene chloride; vinyl resins such as polyvinyl acetate, vinyl chloride-vinyl acetate copolymer, ethylene-vinyl acetate copolymer, or polyacrylic ester; polyester resins such as polyethylene terephthalate or polybutylene terephthalate; polystyrene resin; polyamide resin; resins of copolymers of olefins, such as ethylene or propylene, with other vinyl polymers; ionomers; cellulosic resins such as cellulose diastase; and polycarbonates. Vinyl chloride resins, acryl-styrene resins, or polyester resins are particularly preferred.

In the receptive layer, a release agent is preferably incorporated in the resin from the viewpoint of preventing heat fusion between the receptive layer and the dye layer in the thermal transfer sheet. Release agents usable herein include silicone oils, phosphoric ester surfactants, and fluorocompounds. Among them, silicone oils are particularly preferred. The amount of the release agent added is preferably 0.2 to 30 parts by weight based on 100 parts by weight of the binder resin for forming the receptive layer. If necessary, the receptive layer may be formed on the substrate sheet through the peel layer by adding necessary additives such as a release agent to the resin, dissolving or dispersing the mixture in a solvent such as water or an organic solvent to prepare an ink, and coating the ink by conventional means such as gravure printing, screen printing, or reverse roll coating using a gravure plate, and drying the coating. The coverage of the receptive layer is about 0.1 to 10 $g/m^2$ on a dry basis.

In the intermediate transfer recording medium according to the present invention, an intermediate layer may be formed between the peel layer and the receptive layer provided on the substrate sheet. Various functions are imparted to the intermediate layer to impart excellent functions to a transfer part composed mainly of the receptive layer in the intermediate transfer recording medium (a part, in the intermediate transfer recording medium, to be transferred onto the object). For example, the incorporation of an ultraviolet absorbing agent improves the lightfastness of images. The incorporation of a phosphor can enhance forgery preventive properties and the adhesion between the peel layer and the receptive layer.

Resins usable for constituting the intermediate layer include, for example, polyurethane resins, acrylic resins, polyethylene resins, butadiene rubbers, and epoxy resins. The thickness of the intermediate layer is about 0.5 to 1 μm on a dry basis. The intermediate layer may be formed in the same manner as described above in connection with the receptive layer.

(Peel Layer)

In the intermediate transfer recording medium according to the present invention, the receptive layer may be formed on the substrate sheet through a peel layer 13. The provision of the peel layer enables the receptive layer to be reliably and easily transferred from the intermediate transfer recording medium onto the object.

The peel layer may be formed of, for example, waxes, such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactum, partially modified wax, fatty esters, and fatty amides, and thermoplastic resins, such as silicone wax, silicone resin, fluororesin, acrylic resin, polyester resin, polyurethane resin, cellulose resin, vinyl chloride-vinyl acetate copolymer, and nitrocellulose.

Further, the peel layer may be formed of a binder resin and a releasable material. Binder resins usable herein include thermoplastic resins, for example, acrylic resins, such as polymethyl methacrylate, polyethyl methacrylate, polybutyl acrylate, vinyl resins, such as polyvinyl acetate, vinyl chloride-vinyl acetate copolymer, polyvinyl alcohol, and polyvinylbutyral, and cellulose derivatives, such as ethylcellulose, nitrocellulose, and cellulose acetate, and thermosetting resins, for example, unsaturated polyester resins, polyester resins, polyurethane resins, and aminoalkyd resins. Releasable materials include waxes, silicone wax, silicone resins, melamine resins, fluororesins, fine powders of talc or silica, and lubricants such as surfactants or metal soaps.

The peel layer may be formed by dissolving or dispersing the above-described necessary materials in a suitable solvent to prepare a coating liquid for a peel layer, coating the coating liquid onto a substrate sheet by gravure printing, screen printing, reverse coating using a gravure plate or other means, and drying the coating. The coverage is about 0.05 to 1 μm on a dry basis.

(Backside Layer)

In the intermediate transfer recording medium according to the present invention, a backside layer 14 may be provided on the surface of the substrate sheet remote from the receptive layer from the viewpoint of preventing adverse effect such as heat-derived sticking, cockling or the like caused by a thermal head, a heat roll or the like. Binder resins usable for the backside layer include, for example, cellulosic resins, such as ethylcellulose, hydroxyethylcellulose, hydroxypropylcellulose, methylcellulose, cellulose acetate, cellulose acetate butyrate and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resin, polyvinyltoluene resin, coumarone-indene resin, polyester resin, polyurethane resin, and silicone-modified or fluorine-modified urethane resins.

These resins may be used as a mixture of two or more. In order to further enhance the heat resistance of the backside layer, preferably, among the above resins, a resin containing a reactive group such as a hydroxyl group may be used in combination with polyisocyanate or the like as a crosslinking agent to form a crosslinked resin layer as the backside layer. In order to improve slipperiness against a heating device such as a thermal head, a solid or liquid release agent or lubricant may be added to the backside layer to impart heat-resistant slipperiness to the backside layer. Release agents or lubricants include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesin, silicone resin, and fine particles of inorganic compounds such as talc and silica. The content of the lubricant in the backside layer is preferably 5 to 50% by weight, particularly 10 to 30% by weight, based on the total solid content of the backside layer. The backside layer may be formed by adding a binder resin and optionally additives to prepare an ink, coating the ink onto the substrate sheet by conventional means, and drying the coating. The thickness of the backside layer is preferably about 0.1 to 5 g/m$^2$ on a dry basis.

4. Object

An object 7 will be described. The intermediate transfer recording medium in its part composed mainly of the receptive layer with a thermally transferred image formed thereon is transferred onto the object. In some cases, the receptive layer including the peel layer and the like is transferred from the intermediate transfer recording medium.

In the object used in the present invention, an information recording part comprising a magnetically readable or writable magnetic recording layer and an optically and electrically readable or writable recording layer may be previously formed. In the information recording part, for example, ID information, holder information, and information on money are written according to applications.

The information recording part can be recorded as visible information. However, the information is frequently recorded as non-visible information, for example, from the viewpoints of confidentiality and forgery prevention.

In the present invention, in a method for image formation, comprising the steps of: providing an intermediate transfer recording medium comprising a separable receptive layer provided on at least one side of a substrate sheet; forming a first image on the receptive layer by using a dye layer in a thermal transfer sheet; then thermally transferring a transparent adhesive layer onto the receptive layer; transferring a heat-fusion ink layer onto a transparent adhesive layer transfer part provided on the receptive layer to form a second image; and then transferring the image-formed receptive layer from the intermediate transfer recording medium to an object to form an image on the object, the receptive layer only in its part having an adhesive layer can be adhered onto the object through the adhesive layer without the adhesion of the receptive layer directly onto the object. By virtue of this, the transfer of the receptive layer and the adhesive layer onto the information recording part in the object can be avoided to avoid a deterioration in properties of the information recording part, for example, a lowering in magnetic reading and writing output and contact failure at the time of reading and writing of IC chips.

The object has the above information recording part in its at least a part and may be formed of any base material, and examples thereof include natural pulp paper, coated paper, tracing paper, plastic films which are not deformed upon exposure to heat at the time of transfer, glasses, metals, ceramics, wood, and cloths.

The natural pulp paper is not particularly limited, and examples thereof include wood-free papers, art papers, lightweight coated papers, ultra lightweight coated papers, coated papers, cast coated papers, papers impregnated with synthetic resin or emulsion, papers impregnated with synthetic rubber latex, papers with synthetic resin being internally added thereto, and thermal transfer papers.

Regarding the form and applications of the object, there is no limitation on the type, and examples thereof include: gold notes, such as stock certificates, securities, deeds, passbooks, railway tickets, streetcar tickets, stamps, postage stamps, appreciation tickets, admission tickets, and other tickets; cards, such as bank cards, credit cards, prepaid cards, membership cards, greeting cards, postcards, business cards, driver's licenses, IC cards, and optical cards; cases, such as cartons and containers; bags; forms control; envelops; tags; OHP sheets; slide films; bookmarks; calendars; posters; pamphlets; menus; passports; POP goods; coasters; displays; name plates; keyboards; cosmetics; accessories such as wristwatches and lighters; stationeries such as report pads; building materials; panels; emblems; keys; cloths; clothes; footwears; equipment or devices such as radios, televisions, electronic calculators, and OA equipment; various sample or pattern books; albums; and outputs of computer graphics and outputs of medical images.

EXAMPLES

The following Examples further illustrate the contents of the present invention but should not be construed as limiting the present invention.

Example 1

In the following description, "parts" or "%" is by weight unless otherwise specified.

Preparation of Thermal Transfer Sheet

The following coating composition for a backside layer was gravure coated at a coverage of 1.0 g/m$^2$ on a dry basis onto a substrate sheet of polyethylene terephthalate (PET).

(Composition for Backside Layer)

| | |
|---|---|
| Polyvinyl butyral resin | 3.6 parts |
| Polyisocyanate | 8.6 parts |
| Phosphoric ester surfactant | 2.8 parts |
| Talc | 0.7 part |
| Methyl ethyl ketone | 32.0 parts |
| Toluene | 32.0 parts |

Coating compositions for dye layers were prepared according to the following formulations. These compositions were gravure coated on the surface of the substrate sheet remote from the backside layer at a coverage of 0.8 g/m$^2$ on a dry basis in a face serial manner on the order of Y, M, and C to form dye layer parts 35, 36, and 37 as shown in FIG. 2.

(Composition for Yellow "Y" Dye Layer)

| | |
|---|---|
| Quinophthalone dye | 6.0 parts |
| Polyvinyl acetoacetal resin (KS-5, manufactured by Sekisui Chemical Co., Ltd.) | 3.0 parts |
| Toluene | 45 parts |
| Methyl ethyl ketone | 45 parts |

(Composition for Magenta "M" Dye Layer)

| | |
|---|---|
| Pyrazolotriazolazomethine dye | 4.4 parts |
| Anthraquinone dye | 1.0 part |
| Polyvinyl acetoacetal resin (KS-5, manufactured by Sekisui Chemical Co., Ltd.) | 3.0 parts |
| Toluene | 45 parts |
| Methyl ethyl ketone | 45 parts |

(Composition for Cyan "C" Dye Layer)

| | |
|---|---|
| Indoaniline dye | 4.0 parts |
| Anthraquinone dye | 1.0 part |
| Polyvinyl acetoacetal resin (KS-5, manufactured by Sekisui Chemical Co., Ltd.) | 3.0 parts |
| Toluene | 45 parts |
| Methyl ethyl ketone | 45 parts |

A composition for a release layer was prepared according to the following formulation. This composition was gravure coated at a coverage of 0.5 g/m$^2$ on a dry basis onto the surface of the substrate sheet in layout as shown in FIG. 2 to form a release layer 32.

(Composition for Release Layer)

| | |
|---|---|
| Polyvinyl alcohol resin | 2.0 parts |
| Urethane emulsion resin | 2.6 parts |
| Isopropyl alcohol | 63.6 parts |
| Ion-exchanged water | 31.8 parts |

A composition for a transparent adhesive layer was prepared according to the following formulation. This composition was gravure coated at a coverage of 0.8 g/m$^2$ on a dry basis onto the surface of the release layer in layout as shown in FIG. 2 to form a transparent adhesive layer 33.

(Composition for Transparent Adhesive Layer)

| | |
|---|---|
| Vinyl chloride-vinyl acetate copolymer resin (VY-LFX, manufactured by Union Carbide) | 30 parts |
| Toluene | 35 parts |
| Methyl ethyl ketone | 35 parts |

A composition for a release layer was prepared according to the above formulation. This composition was gravure coated at a coverage of 0.5 g/m$^2$ on a dry basis onto the surface of the substrate sheet in layout as shown in FIG. 2 to form a release layer 32.

A composition for a heat-fusion ink layer was prepared according to the following formulation. This composition was gravure coated at a coverage of 0.8 g/m$^2$ on a dry basis onto the surface of the release layer in layout as shown in FIG. 2 to form a heat-fusion ink layer 34. Thus, a thermal transfer sheet of Example 1 was prepared.

(Composition for Heat-Fusion Ink Layer)

| | |
|---|---|
| Vinyl chloride-vinyl acetate copolymer resin (VY-LFX, manufactured by Union Carbide) | 17.5 parts |
| Carbon black | 12.5 parts |
| Toluene | 25.0 parts |
| Methyl ethyl ketone | 35.0 parts |
| Ethyl acetate | 10.0 parts |

Preparation of Intermediate Transfer Recording Medium

A 12 μm-thick transparent polyethylene terephthalate film was first provided as a substrate film. The following coating liquid for a peel layer was gravure coated on the surface of the substrate film, and the coating was dried to form a 0.8 μm-thick (dry basis) peel layer on the whole area of the substrate film.

(Composition for Peel Layer)

| | |
|---|---|
| Acrylic resin (BR-83, manufactured by Mitsubishi Rayon Co., Ltd.) | 88 parts |
| Polyester resin | 1 part |
| Polyethylene wax | 11 parts |
| Methyl ethyl ketone | 50 parts |
| Toluene | 50 parts |

Figure 4:
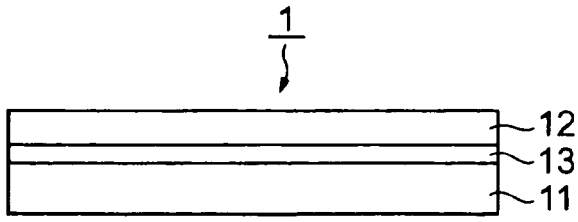
FIG. 4 is a schematic cross-sectional view showing an embodiment of an intermediate transfer recording medium according to the present invention.

The following coating liquid for a receptive layer was gravure coated on the peel layer, and the coating was dried to form a 1.5 μm-thick (dry basis) receptive layer. Thus, an intermediate transfer recording medium 1 as shown in FIG. 4 was prepared.

(Coating Liquid for Receptive Layer)

| | |
|---|---|
| Vinyl chloride-vinyl acetate copolymer (VY-LFX, manufactured by Union Carbide) | 40 parts |
| Acrylic silicone | 2.0 parts |
| Methyl ethyl ketone | 50 parts |
| Toluene | 50 parts |

Evaluation Test (Printing Test 1)

The thermal transfer sheet and the intermediate transfer recording medium prepared above were loaded into a thermal transfer printer (CX 710, manufactured by Victor Data Systems Co., Ltd.). An image 1 having a reflection density of 0.7 to 1.0 as measured with a Macbeth RD-918 densitometer Visual Filter was analyzed to produce signals which were then sent to a thermal head provided in the printer, and the Y, M, and C dye layers were thermally transferred from the thermal transfer sheet onto the receptive layer face of the intermediate transfer recording medium to form a first image (4) on the receptive layer. Thereafter, a transparent adhesive layer 22 was thermally transferred by means of the thermal head provided in the printer so that the size of the transferred transparent adhesive layer 22 is larger than the size of the image 1 region (4) and the layout of the transparent adhesive layer 22, when finally transferred onto an object, was as shown in FIG. 1. Thereafter, information of a character of 8 point size was analyzed to produce electric signals which were then sent to the thermal head provided in the printer, and a second image 5 was formed in a transparent adhesive layer transfer region using the heat-fusion ink layer. The following object was put on top of the intermediate transfer recording medium, and the assembly was heated by means of a heat roller provided in the printer from the intermediate transfer recording medium in its side remote from the receptive layer to conduct transfer onto the object, thereby an image formed object 6, as shown in FIG. 1, comprising the object integrated with a thermally transferred dye image 4, a transparent adhesive layer 22, and a heat-fusion ink layer-derived thermally transferred image 5 was provided.

(Object)

| | |
|---|---|
| Polyvinyl chloride composition (degree of polymerization 800; containing about 10% additive (stabilizer)) | 100 parts |
| White pigment (titanium oxide) | 10 parts |
| Plasticizer (DOP) | 0.5 part |

(Comparative Example 1)

Figure 5:
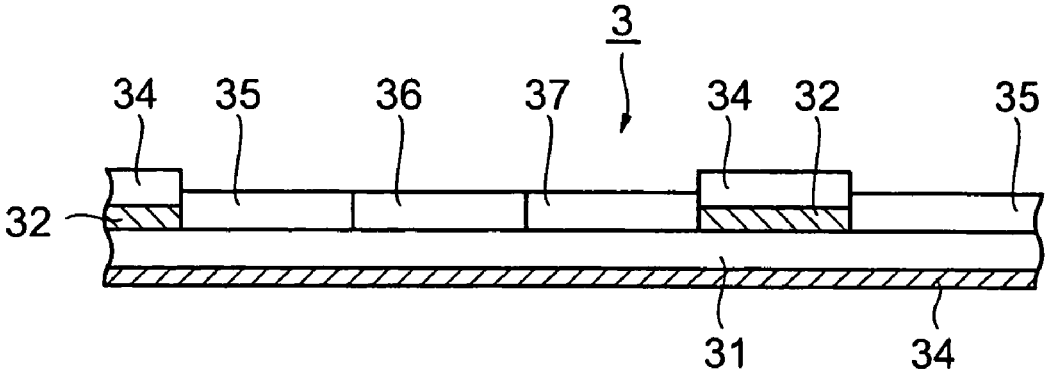
FIG. 5 is a schematic cross-sectional view showing an example of a comparative thermal transfer sheet.

A thermal transfer sheet of Comparative Example 1 was prepared. The thermal transfer sheet of Comparative Example 1 had the same construction as the thermal transfer sheet of Example 1, except that the transparent adhesive layer was omitted. Specifically, in the thermal transfer sheet of Comparative Example 1, in layout as shown in FIG. 5, a Y dye layer 35, an M dye layer 36, a C dye layer 37, and a heat-fusion ink layer part composed of a stack of a release layer 32 and a heat-fusion ink layer 34 were formed in that order in a face serial manner. The same intermediate transfer recording medium as prepared in Example 1 was provided. A printing test 2 was carried out under the following conditions.

(Printing Test 2)

An image formed object of Comparative Example 1 (a print formed by the method for image formation without any adhesive layer) was formed using the thermal transfer sheet of Comparative Example 1 and the same intermediate transfer recording medium as prepared in Example 1 in the same manner as in printing test 1.

The quality of the heat-fusion ink layer-derived image (character) formed in the image formed object prepared in printing test 1 was compared with the quality of the heat-fusion ink layer-derived image (character) formed in the image formed object prepared in printing test 2. As a result, it was found that, in the image formed object prepared in printing test 2, missing of a part of the character part was observed, whereas, in the image formed object prepared in printing test 1, the whole character part including a character thin line region was free from missing and the image quality was excellent.

Example 2

Printing test 3 was carried out using the thermal transfer sheet and the intermediate transfer medium prepared in Example 1 under the following conditions.

(Printing Test 3)

The thermal transfer sheet and the intermediate transfer recording medium prepared in Example 1 were loaded into a thermal transfer printer (CX 710, manufactured by Victor Data Systems Co., Ltd.). An image 1 having a reflection density of 0.7 to 1.0 as measured with a Macbeth RD-918 densitometer Visual Filter was analyzed to produce signals which were then sent to a thermal head provided in the printer, and the Y, M, and C dye layers were thermally transferred from the thermal transfer sheet onto the receptive layer face of the intermediate transfer recording medium to form a first image on the receptive layer. Thereafter, a transparent adhesive layer was thermally transferred by means of the thermal head provided in the printer on a part of the image 1 so that the size of the transparent adhesive layer was smaller than the size of an object in its transferred layer receiving face.

Thereafter, information of a character of 8 point size was analyzed to produce electric signals which were then sent to the thermal head provided in the printer, and an image was formed in a transparent adhesive layer transfer region using the heat-fusion ink layer. The same object as used in printing test 1 was then put on top of the intermediate transfer recording medium, and the assembly was heated by means of a heat roller provided in the printer from the intermediate transfer recording medium in its side remote from the receptive layer to conduct transfer onto the object, thereby forming an image formed object comprising the object having, on a part thereof, and integrated with a thermally transferred dye image, a transparent adhesive layer, and a heat-fusion ink layer-derived thermally transferred image.

An image formed object prepared in printing test 3 was visually inspected. As a result, an image formed object could be prepared wherein the region transferred onto the object conformed to the transparent adhesive layer transfer region and the thermally transferred image, particularly the heat-fusion ink-layer derived thermally transferred image, was free from image omission and had excellent image quality, and a transfer region could be formed at a desired position.

Example 3

Printing test 4 was carried out using the thermal transfer sheet and the intermediate transfer recording medium prepared in Example 1 under the following conditions.

(Printing Test 4)

Figure 6:
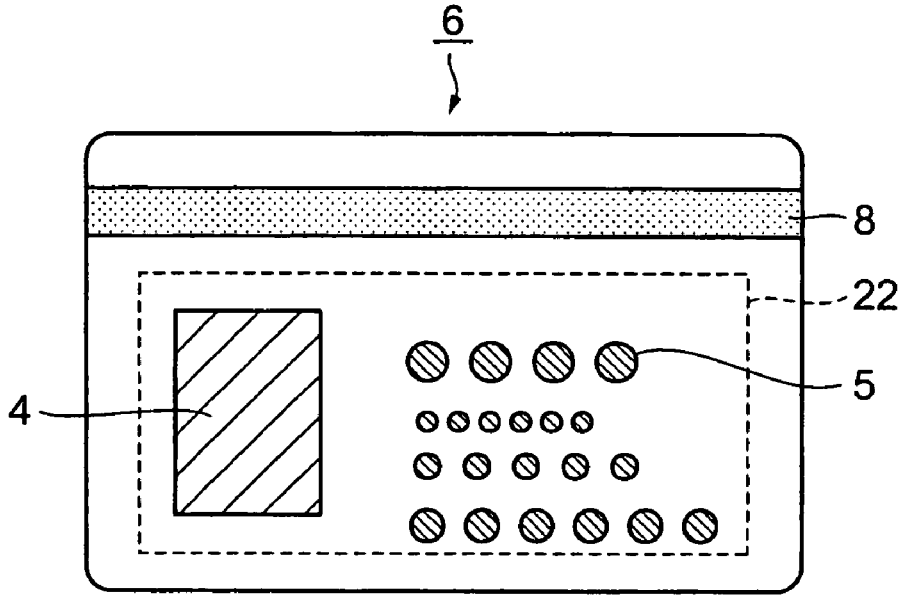
FIG. 6 is a schematic plan view showing an embodiment of an image formed object according to the present invention.

The thermal transfer sheet and the intermediate transfer recording medium prepared in Example 1 were loaded into a thermal transfer printer (CX 710, manufactured by Victor Data Systems Co., Ltd.). An image 1 having a reflection density of 0.7 to 1.0 as measured with a Macbeth RD-918 densitometer Visual Filter was analyzed to produce signals which were then sent to a thermal head provided in the printer, and the Y, M, and C dye layers were thermally transferred from the thermal transfer sheet onto the receptive layer face of the intermediate transfer recording medium to form a first image (4) on the receptive layer. Thereafter, as shown in FIG. 6, a transparent adhesive layer 22 was thermally transferred by means of the thermal head provided in the printer so as to avoid a magnetic strip part 8 provided in the object.

Thereafter, information of a character of 8 point size was analyzed to produce electric signals which were then sent to the thermal head provided in the printer, and a second image (5) was formed in an adhesive layer transfer region using the heat-fusion ink layer. An object of a PET-G card with a magnetic strip satisfying JIS was then put on top of the intermediate transfer recording medium, and the assembly was heated by means of a heat roller provided in the printer from the intermediate transfer recording medium in its side remote from the receptive layer to conduct transfer onto a part of the object, thereby forming an image formed object 6 comprising the object integrated with a thermally transferred dye image 4, a transparent adhesive layer 22, and a heat-fusion ink layer-derived thermally transferred image 5 as shown in FIG. 6.

An image formed object prepared in printing test 4 was visually inspected. As a result, it was found that the region transferred onto the object conformed to the transparent adhesive layer transfer region, the transfer layer was not stacked from the intermediate transfer recording medium onto the magnetic stripe part to prevent a lowering in magnetic reading performance, the transferred image part was free from character omission, and, thus, the image formed object has excellent image quality.

Example 4

Transferability T1 and Transferability T2 as defined in claim 6 were measured using the thermal transfer sheet and the intermediate transfer recording medium prepared in Example 1. The results were transferability T1: (X=191)/255 gradation and. T2: (Y=95)/255 gradation.

The invention claimed is:

1. A method for image formation, comprising the steps of:

providing an intermediate transfer recording medium comprising a receptive layer provided separably on at least one side of a substrate sheet;

forming a first image on the receptive layer by using a thermal transfer sheet comprising a dye layer;

forming a transparent adhesive layer on the receptive layer with the first image formed thereon by using a thermal transfer sheet comprising a transparent adhesive layer;

forming a second image on the transparent adhesive layer by using a thermal transfer sheet comprising a heat-fusion ink layer; and transferring the processed receptive layer from the intermediate transfer recording medium to an object to form an image on the object.

2. The method for image formation according to claim 1, wherein the transparent adhesive layer is transferred onto the receptive layer only in its desired region.

3. The method for image formation according to claim 2, wherein the receptive layer is not wholly adhered onto the object and the receptive layer only in its transparent adhesive layer-formed part is adhered onto the object.

4. The method for image formation according to claim 1, wherein a single thermal transfer sheet comprising the dye layer, the transparent adhesive layer, and the heat-fusion ink layer is used to form the first image, to form the transparent adhesive layer, and to form the second image.

5. An object comprising an image formed by the method for image formation according to any one of claims 1 to 4.

* * * * *